United States Patent [19]

Tong

[11] Patent Number: 4,630,717

[45] Date of Patent: Dec. 23, 1986

[54] EXPANDABLE CARRYING CASE

[76] Inventor: Kun-Yuan Tong, 2308 W. Doublegate Dr., Albany, Ga. 31707

[21] Appl. No.: 728,081

[22] Filed: Apr. 29, 1985

Related U.S. Application Data

[63] Continuation-in-part of Ser. No. 592,563, Mar. 23, 1984.

[51] Int. Cl.[4] ..... A45C 7/00

[52] U.S. Cl. ..... 190/104; 190/105; 190/107; 220/8

[58] Field of Search ..... 190/100, 103, 104, 105, 190/107; 206/523; 220/8, 262; 312/312

[56] References Cited

U.S. PATENT DOCUMENTS

| | | | |
|---|---|---|---|
| 554,298 | 2/1896 | Palica | 190/104 |
| 1,241,210 | 9/1917 | Harvey | 190/104 |
| 1,646,286 | 10/1927 | Gadsby | 190/105 |
| 1,705,526 | 3/1929 | Kenneoy | 190/105 |
| 1,759,930 | 5/1930 | Atkins | 190/104 |
| 2,110,617 | 3/1938 | Saling | 190/103 |
| 4,106,597 | 8/1978 | Shook et al. | 206/523 |

FOREIGN PATENT DOCUMENTS

| | | | |
|---|---|---|---|
| 639722 | 6/1928 | France | 190/104 |
| 7322372 | 1/1975 | France | 190/104 |
| 269710 | 2/1927 | United Kingdom | 190/105 |
| 580515 | 9/1946 | United Kingdom | 190/103 |

*Primary Examiner*—Joseph Man-Fu Moy
*Assistant Examiner*—David T. Fidei
*Attorney, Agent, or Firm*—Newton, Hopkins & Ormsby

[57] ABSTRACT

A variable volume carrying case of diverse utility includes hinged companion sections each having relatively movable telescoping portions whereby each case section can be expanded or reduced in size. An independent push-pull cable drive system for the expansion and reduction of each case section includes a rotary manual drive device having a connection with each push-pull cable of the system.

8 Claims, 7 Drawing Figures

EXPANDABLE CARRYING CASE

BACKGROUND OF THE INVENTION

This application is a continuation-in-part of my prior application, Ser. No. 592,563, filed Mar. 23, 1984, for an Expandable Double-Cased Brief-Suitcase With Shift Cable Lock.

The objective of the present invention is to provide a simplified and improved variable volume carrying case for diverse usage including business and personal travel.

More specifically, an object of the invention is to provide a carrying case including substantially twin hinged casing sections, each of which is formed by two relatively adjustable telescopically engaged portions, operated by a compact push-pull cable drive system which includes a rotating operator of low profile design attached to the interior of the major side walls of the case.

A further object is to provide an expandable carrying case which is practical and reliable in its operation as well as economical and feasible to manufacture.

Other features and advantages of the invention will become apparent during the course of the following description.

DETAILED DESCRIPTION

Figure 1:
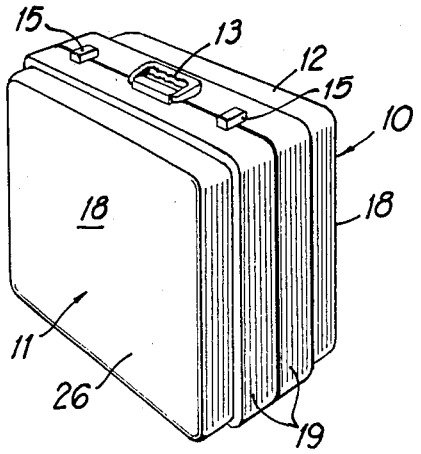
FIG. 1 is a perspective view of a variable volume case according to the present invention in the fully enlarged or expanded state.
Figure 2:
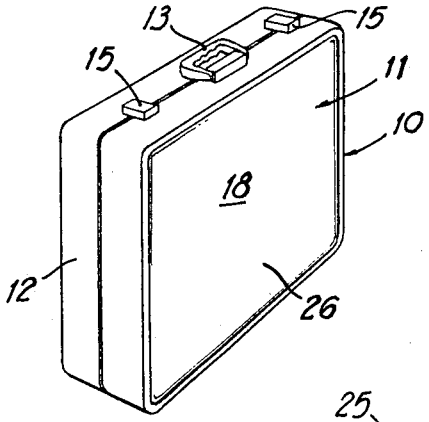
FIG. 2 is a perspective view of the same case in a fully contracted or reduced volume state.

Referring to the drawings in detail wherein like numerals designate like parts, a variable volume carrying case 10 according to the present invention includes hingedly connected companion sections 11 and 12 which are substantially identical except for the fact that one case section is equipped with a carrying handle 13 and latch components 14 while the other case section has no handle and carries only latch components 15 which engage the components 14 to secure the carrying case in a closed condition, as shown in FIGS. 1 and 2.

One section of the carrying case, which may be considered as a bottom section, namely the section 11 in the drawings, is preferably equipped with a soft flexible pad 16 having a center cut-out 17 which can receive a cable operator, yet to be described. The pad 16 is for the protection of fragile articles, such as office machines, cameras or the like. The pad could be omitted, if preferred. Except for the above, the case sections 11 and 12 can be considered as identical in construction and operation, and therefore a detailed description of one will suffice to describe both.

Figure 4:
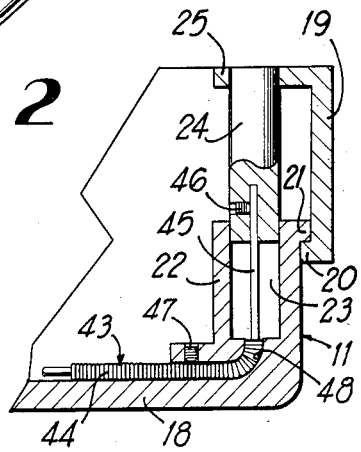
FIG. 4 is an enlarged fragmentary vertical section taken on line 4—4 of FIG. 3.

Each case section comprises an exterior tray-like portion 18 defining one major side wall of the carrying case, and this tray-like portion is telescoped within an interior sleeve portion 19 which is hinged to the corresponding portion of the other companion section of the case. The telescopically engaged portions 18 and 19 have opposing preferably continuous flanges 20 and 21, FIG. 4, which engage to limit expansion or enlargement of the case section 11 or 12.

Each case section is equipped at the corners of its traylike portion 18 with bosses 22, each having a bore 23 receiving therein movably a plunger pin 24 carried by a corner web 25 of the sleeve portion 19. It will be understood that each case section has the identical boss and plunger pin arrangement shown in FIG. 4 at each of its four corners.

At the center and on the interior face of the main wall 26 of each case section is a low profile cable operator assembly 27. This assembly comprises a cylindrical housing 28 having an end flange 29 attached by screws 30 to the main wall 26. The housing 28 has an end wall 31 provided with a circular opening 32 with a series of circumferentially spaced notches 33 provided in the peripheral edge of the opening 32. The housing side wall 28 has four circumferentially equidistantly spaced substantially tangential tunnel openings 34 formed therethrough and communicating with a like number of tangential slots 35 formed in the flange 29.

Rotatably mounted within the housing 28 is a manually turnable cylindrical cable drive member 36 having an end flange 37 which fits beneath the end wall 31 of the housing 28. The turnable drive member 36 is formed to provide across its diameter a dovetailed cross-section slot 38, open at one end, and receiving therein slidably a dovetailed finger operated locking bar or key 39. The sliding key 39 has a flat top flange 40 to be engaged by the thumb or fingers and has a reduced extension 41 at one end of the key for selective engagement in one of the notches 33 of the stationary housing 28. The key 39 is biased longitudinally toward the notches 33 by a compression spring 42 bearing on the rear end of the key within the slot 38, as shown. The key extension 41 can be retracted from each notch 33 by the thumb or fingers.

Four push-pull cable assemblies 43 are provided to operate the plunger pins 24 in the bores 23. Each cable assembly includes a guide sheath 44 for an internal longitudinally movable push-pull wire 45. One end of each wire 45 is secured by a set screw 46, FIG. 4, to a plunger pin 24. The adjacent end portion of each sheath 44 is secured by another set screw 47 within a passage 48 provided in the tray-like portion 18 at one end of the boss 22.

The other end of each push-pull wire 45 carries an L-bracket 49 which is attached by a screw 50 to the periphery of the cylindrical turnable drive member 36, the latter having circumferentially spaced screw receiving openings 51. The adjacent ends of the cable sheaths 44 are engaged in the tunnel openings 34 and slots 35 of the housing 28 snugly.

Figure 3:
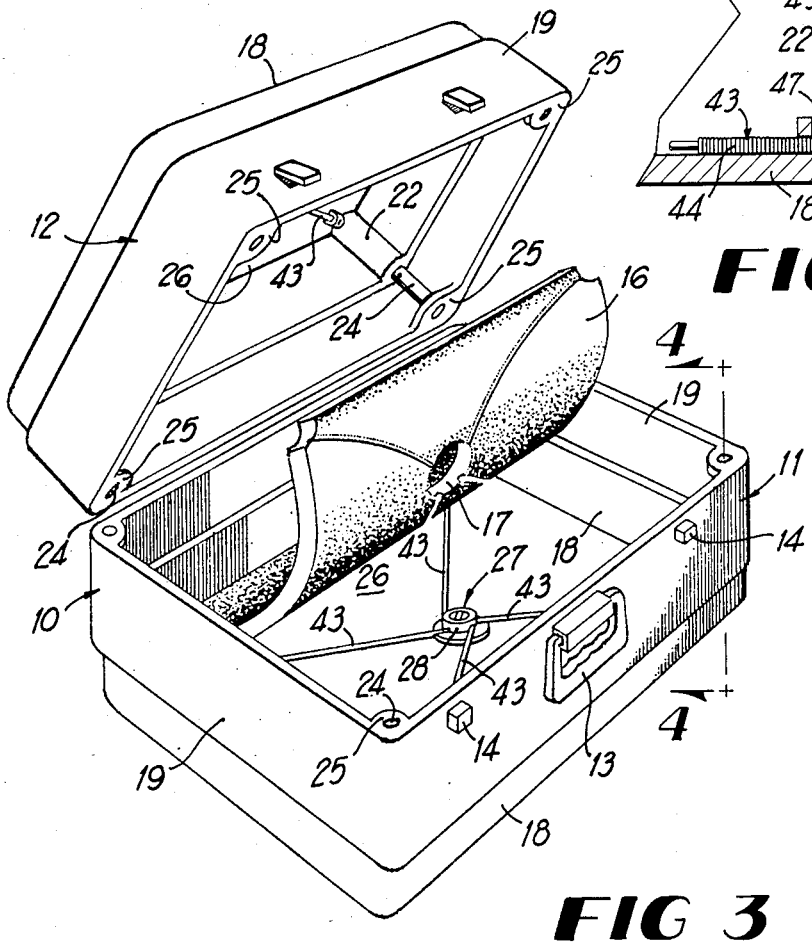
FIG. 3 is a perspective view showing the interior of the case and its cable operating means.
Figure 5:
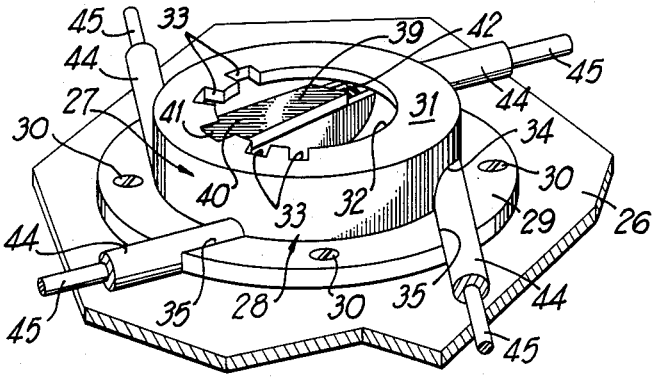
FIG. 5 is a perspective view of the cable operator provided on each hinged section of the case.
Figure 6:
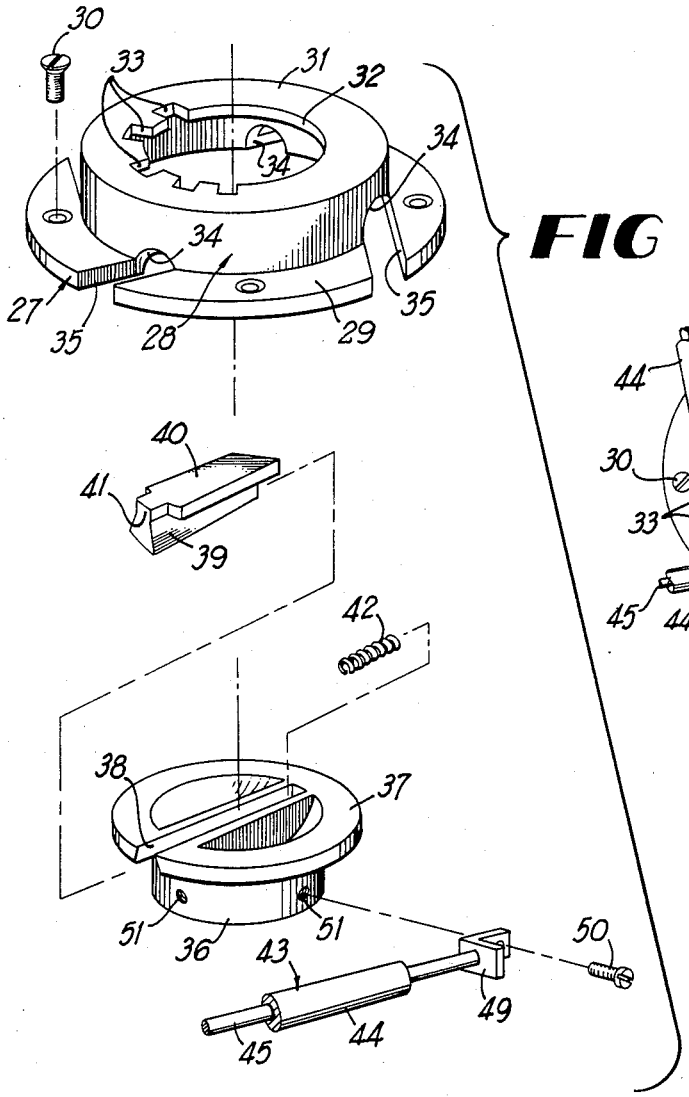
FIG. 6 is an exploded perspective view of the operator.
Figure 7:
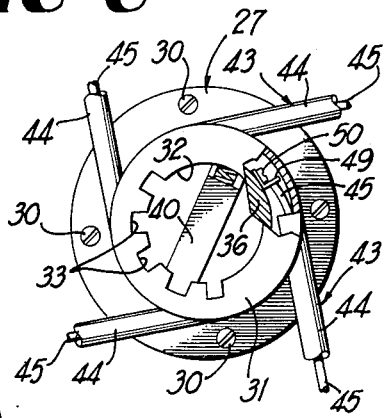
FIG. 7 is a plan view thereof, partly in section.

As shown in FIG. 3, the push-pull cable assemblies of each case section 11 and 12 radiate from the operator assembly 27 toward the four corners of the case which contain the bosses 22 and plunger pins 24. The push-pull cables 43 lie close to the main case walls 26 so as to be out of the way.

The sleeve portions 19 are each moved inwardly or outwardly relative to the tray-like portions 18 by manual turning of the member 36 of each case section. The two case sections 11 and 12 are therefore enlarged or made smaller independently, and each can be enlarged or reduced in volume without changing the other, as desired. The circumferential span of the notches 33 is such that the entire range of expandability and reduction of each case section is enabled. The two portions 18 and 19 can be locked in a number of adjusted positions by virtue of the notches 33 and key 39. The mechanism is simple, strong, reliable and convenient to operate and its advantages over known prior art structures should be apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A variable volume carrying case comprising a pair of hinged case sections each including telescoping relatively movable portions having stop means thereon to limit relative movement in one direction, a push-pull cable operating system for each carrying case section including a manually turnable and releasably lockable operator and four push-pull cable assemblies operatively connected between said operator and said portions, and including a housing on one of said portions with circumferentially spaced adjusting means for said operator for locking said portions in selected positions.

2. A variable volume carrying case as defined in claim 1, and said push-pull cable operating system further including for each push-pull cable assembly a plunger on one telescoping portion secured to the push-pull cable of each assembly, and a plunger guide passage means on the other portion and being connected to the sheath of each cable assembly.

3. A variable volume carrying case as defined in claim 1, and said adjusting means comprising circumferentially spaced notches in said housing, and a spring-urged locking key on said turnable operator engageable selectively and releasably in any of said notches.

4. A variable volume carrying case as defined in claim 1, and said housing and turnable operator being located substantially at the center of the major wall of each case section, and the four push-pull cable assemblies radiating from said housing toward the corners of the case section and being operatively connected with said telescoping portions of the case section at said corners, said cable assemblies lying close to and parallel with said major wall.

5. A variable volume carrying case as defined in claim 1, and said housing having circumferentially spaced side wall passages adapted to receive adjacent end portions of the push-pull cable assemblies.

6. A variable volume carrying case comprising a pair of hingedly connected substantially identical case sections each including telescopically engaged tray-like and sleeve portions which are relatively movable to vary each case section, cooperative stop means on the tray-like and sleeve portions to limit relative movement thereof in one direction, interfitting plunger and guide passage means on said portions near the corners of each case section, a corresponding number of push-pull cable assemblies operatively connected with said plunger and guide passage means and extending therefrom toward the center of each case section, and a common rotary operator means for said push-pull pull cable assemblies substantially at the center of each case section and being connected with the cable assemblies and being fixed to the major wall of the tray-like portion.

7. A variable volume carrying case as defined in claim 6, and said interfitting plunger and guide passage means comprising bosses on the tray-like portion at the corners thereof and having bores, and plungers on the sleeve portion near the corners thereof and being engaged guidingly in said bores.

8. A variable volume carrying case as defined in claim 6, and said common rotary operator means comprising a housing fixed centrally on said major wall, a turnable manual operator in said housing and being connected to push-pull cables of said assemblies, and cooperative means on said housing and turnable manual operator to releasably lock the latter in a plurality of selected adjusted positions.

* * * * *